United States Patent [19]

Sakamoto

[11] 4,274,074

[45] Jun. 16, 1981

[54] SLIDE TYPE VARIABLE RESISTOR HAVING DUAL TRACKS

[75] Inventor: Nozomu Sakamoto, Tokyo, Japan

[73] Assignee: Alps Electric Co., Ltd., Tokyo, Japan

[21] Appl. No.: 47,344

[22] Filed: Jun. 8, 1979

[30] Foreign Application Priority Data

Sep. 6, 1978 [JP] Japan ..... 53-78764[U]

[51] Int. Cl.[3] ..... H01C 10/30

[52] U.S. Cl. ..... 338/160; 338/123; 338/128; 338/161; 338/171; 338/176; 338/185; 338/188

[58] Field of Search ..... 338/160, 161, 140, 185, 338/159, 123, 125, 126, 155, 157, 176, 188, 194, 128, 185, 171, 202

[56] References Cited

U.S. PATENT DOCUMENTS

| | | | |
|---|---|---|---|
| 3,307,133 | 2/1967 | Wolf | 338/194 |
| 3,337,831 | 8/1967 | Scott | 338/126 |
| 3,550,059 | 12/1970 | Barden et al. | 338/176 |
| 4,003,388 | 1/1977 | Nopanen | 338/194 X |

FOREIGN PATENT DOCUMENTS 47-26210 8/1972 Japan .

*Primary Examiner*—C. L. Albritton

*Attorney, Agent, or Firm*—Guy W. Shoup; Gerard F. Dunne

[57] ABSTRACT

Disclosed is a variable resistor of the slide type incorporating a pair of resistor units carried on the same base plate and disposed in parallel with respect to each other. A plurality of conductive taps angle outwardly from a resistance member provided in each of the resistor units and a pair of sliders can be slidingly moved along and in contact with the series of the plurality of conductive taps in the pair of conductor units, respectively, but do not contact the resistance members directly.

8 Claims, 8 Drawing Figures

SLIDE TYPE VARIABLE RESISTOR HAVING DUAL TRACKS

The present invention relates to variable resistors, and more particularly, to a slide type variable resistor having dual tracks and useful in relatively high wattage applications such as controlling a fader of a stereophonic audio device carried within a motor vehicle or the like.

Conventional variable resistors used for controlling such faders, in general, have slider pieces which slidingly contact directly with resistance members. When the slider piece contacts the resistance member of such conventional variable resistors, however, a concentrated contact resistance appears at the point of contact resulting in a considerably large comsumption of electric power and generation of a relatively large amount of heat. This effect is especially pronounced in variable resistors of this type used in high wattage applications, since an arc may be generated between the slider piece and the resistance member as a result of the relatively large current flowing through the resistance member. Thus, wear of the resistance member due to the heat of the arc is quite large. Accordingly, for variable resistors of this type, it has been an important problem to make the concentrated contact resistance as small as possible in order that the resistor be sufficiently safeguarded against wear of the resistance member during use in high power applications. Further, the space allocated in a motor vehicle for an onboard stereophonic audio device is extremely limited and, accordingly, it has been necessary to provide an improved variable resistor which is compact and yet sufficiently safeguarded against the wear normally associated with use in high power applications and also is easy to operate during driving of the motor vehicle.

Accordingly, an object of the present invention is to provide a variable resistor wherein the slider does not directly make contact with the resistance member thereof.

Another object of the present invention is to provide a variable resistor which does not generate much heat during use and is sufficiently safeguarded against the wear normally associated with use in high power applications.

A further object of the present invention is to provide a slide type variable resistor having a dual track and which is sufficiently compact for use in an onboard stereophonic audio device or the like and has a superior workability.

The above and other objects and advantages of the present invention will be apparent from the following detailed description made in conjunction with the accompanying drawings, in which.

Figure 1:
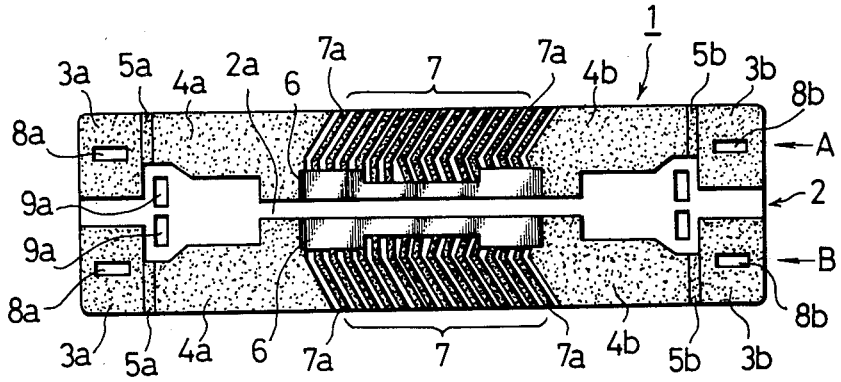
FIG. 1 is a top elevational view of an embodiment of a resistor base of the present invention.

An embodiment of the present invention will now be described in conjunction with FIGS. 1 to 8. In the figures, the numeral 1 indicates a resistor base which comprises a rectangular insulating base plate 2 made of a heat-proof material such as a thermosetting synthetic plastic material. The base plate 2 has thereon patterns of resistor track assemblies A and B which are symmetrically formed with respect to a central isolation band 2*a* disposed therebetween. The track assemblies each include terminal portions 3*a* and 3*b* for connection with output terminals, and conductive portions 4*a* and 4*b* for contact slidingly with a slider 24 which will be described below. The terminal portions 3*a* and 3*b* and the conductive portions 4*a* and 4*b* may comprise films formed by printing or coating a conductive material such as silver paste or the like and then baking it on the base plate. The terminal portion 3*a* and the conductive portion 4*a* of each track are connected to each other, and the terminal portion 3*b* and the conductive portion 4*b* of each track are connected to each other by means of respective joint portions which separate the terminal portions from the associated conductive portions. The joint portions are formed by respective films 5*a* and 5*b* formed from resistive carbon paste and prevent solder, which is applied to the connecting terminals, as will be described hereinbelow, from spreading.

The numeral 6 indicates resistance members each made from a resistive carbon film and interconnecting the conductive portions 4*a* and 4*b* of respective tracks. Between each resistance member 6 and the adjacent longitudinal edge of the insulating base plate 2 is provided a respective tap portion 7 consisting of a plurality of elongated tap films 7*a* each of good conductivity and formed by printing and baking a conductive material such as silver paste in a configuration resembling the teeth on a comb. The tap films 7*a* of each track are connected to the respective resistance member 6 and spaced from one another, and extend in an angular direction with respect to the longitudinal direction of the insulating base plate 2. The tap portions 7 are adapted to be contacted slidingly with contact pieces 26*a* and 26*b* of the slider 24 as will be described below. If required, an insulating coating may be provided between the respective tap films 7*a*, and between the tap films 7*a* and the conductive portions 4*a* and 4*b* thereby to make the surface of the tap portion 7 smooth for preventing wear due to the sliding contact and for effecting an agreeable feeling of operation. The numerals 8*a*, 8*b*, 9*a* and 9 *b* indicate holes provided through the insulating base plate 2 for mounting terminals.

Figure 2:
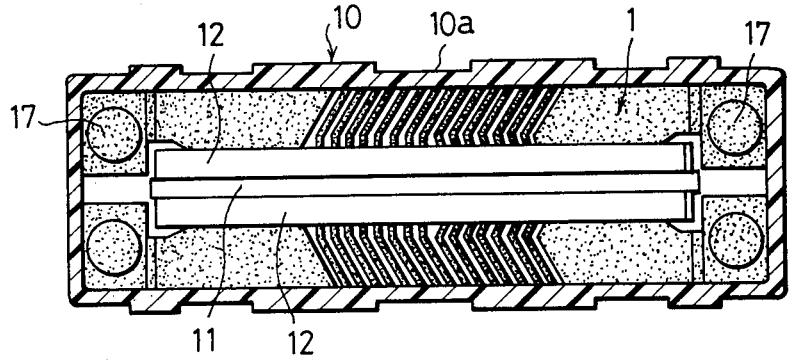
FIG. 2 is a top elevational view of an embodiment of the present invention with the cover and slider mechanism removed.
Figure 3:
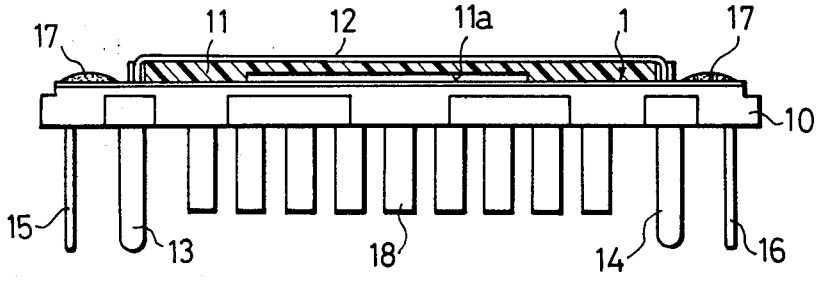
FIG. 3 is a side elevational view of the embodiment of FIG. 2.

Referring now to FIGS. 2 and 3, the numeral 10 indicates a rectangular frame member made from an insulating material such as synthetic resin, into which frame 10 is fitted the resistor base 1. Above the central isolating band 2*a* of the base 1 and between the terminal mounting holes 9*a* and 9*b* is secured an elongate rectangular bridge member 11 having a central recessed portion 11*a* formed in the lower portion thereof for spanning both of the resistance members 6 so that the bridge member will avoid contact with the resistance members. A pair of elongate, narrow conductive bands 12 consisting of respective metal bands having good conductivity are disposed, with a suitable spacing therebetween, on the upper surface of the bridge member 11 and lie parallel to the longitudinal direction thereof. The opposite end portions of each of the conductive bands 12 are bent over the underlying ends of the bridge member 11, and are each passed through respective mounting holes 9*a* or 9*b*. The extremities of the bent end portions of the bands 12 project through to the undersurface of the base plate 2 and constitute input terminals 13 and 14. The terminals 13 and 14 are themselves fixedly secured to the base 1 by suitable means such as by being twisted and, at the same time, serve as members fixing the conductive bands 12 to the bridge member 11. Output terminals 15 and 16 are provided for each track, and each have one end portion thereof passed through a mounting hole 8*a* or 8*b* for secure connection to a terminal portion 3*a* or 3*b* by solders 17. In this way, the output terminals 15 and 16 are also fixedly secured to the resistor base 1. The numeral 18 indicates a plurality of air-cooling fins integrally provided to a heat-conducting plate (not shown) to serve as a radiator in case the variable resistor is of a type to be used in relatively high wattage applications. The numeral 10*a* indicates depressed portions of the frame member 10 for mounting a cover 19 which will be described hereinbelow.

Figure 4:
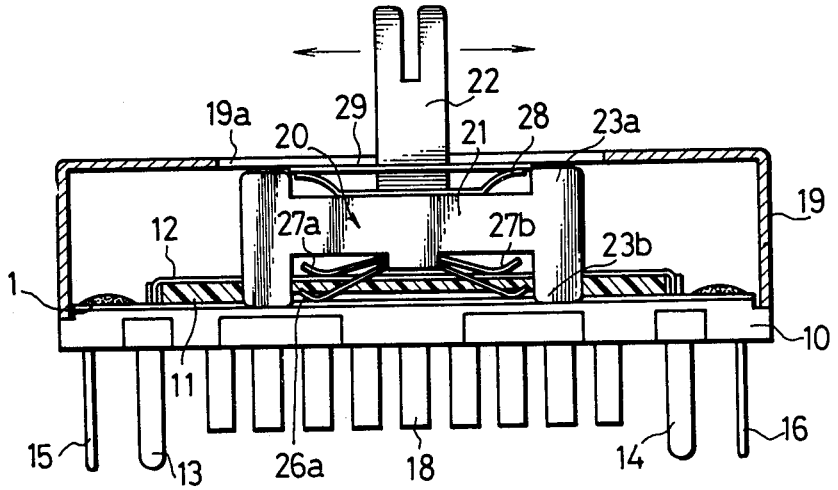
FIG. 4 is a side sectional view of the illustrative embodiment.

Referring now to FIG. 4, a rectangular box-like cover 19 is mounted to the base 1 and is fixedly secured thereto by suitable means. The numeral 20 indicates a slider holder made from an insulating material such as synthetic resin. The holder 20 comprises a rectangular base portion 21 having a lever 22 extending upwardly from the center portion thereof, and upper guide portions 23*a* and lower guide portions 23*b* projecting respectively from the four corner portions thereof. The slider holder 20 is placed on the resistor base 1 with the lever 22 extending through a guide slot 19*a* provided in the upper wall of the cover 19, and thus the holder is guided by the guide portions 23*a* and 23*b* for sliding within the cover 19.

Figure 5:
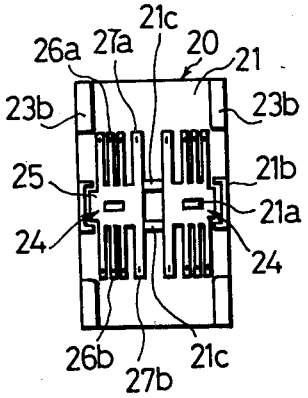
FIG. 5 is a bottom view of the slider mechanism of FIG. 4.
Figure 6:
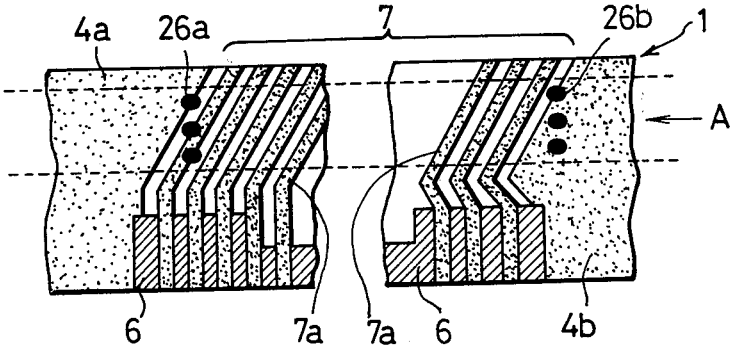
FIG. 6 is a plan view of a portion of the resistor base of FIG. 1.

The base portion 21 of the slider holder 20 has a pair of sliders 24 mounted on the lower surface thereof. Each slider 24 is made from a thin metal plate of good resiliency, and has a plurality of outer contact pieces arranged in groups 26*a* and 26*b* and inner contact pieces 27*a* and 27*b* formed on respective sides of a transverse support portion 25. The contact pieces are arranged symmetrically with respect to each other, as shown in FIG. 5, and are each bent downwards at suitable angles with respect to the support portion 25. Each slider 24 is mounted on the lower surface of the base portion 21 of the slider holder 20 between a generally C-shaped projection 21*b* and central projections 21*c* provided on the lower surface of the base portion 21. A respective mounting hole (not labeled) provided in each support portion 25 is fitted to a respective projection 21*a* provided on the back surface of the base plate 21 to thereby hold the slider in position.

The contact pieces 26*a* and 26*b* of each slider 24 are adapted to contact with the same slide track A or B consisting of conductive portions 4*a* and 4*b* and the tap portion 7 therebetween, while the contact pieces 27*a* and 27*b* are adapted to contact with the conductive band 12 associated with the slide track. When the contact pieces 26*a* and 27*b* slide along a slide track as shown by dashed lines in FIG. 6, these contact pieces come into contact in turn with the plurality of tap films 7*a* of the tap portion 7, so that resistance value appearing between the input terminal 13 or 14 and the output terminal 15 or 16 may be varied in steps. Each group of the plurality of contact pieces 26*a* and 26*b* comes into contact simultaneously with adjacent tap films 7*a* or with a tap film 7*a* and the adjacent conductive portion 4*a* or 4*b*, depending on the direction of movement of the contact pieces, as can be seen from FIG. 6. In this way, no disconnection of all the contact pieces 26*a* or 26*b* ever occurs in the circuit. The distance between the points of the contact pieces 26*a* and 26*b* engaging the respective tracks, and the distance between the points of the contact pieces 27*a* and 27*b* engaging the respective conductive bands 12 are made to be equal to the length of the resistance members 6. While the above descriptions and illustrations have been made with respect to the resistor track assembly A, these descriptions are also true of the resistor track assembly B.

Referring again to FIG. 4, the numeral 28 indicates a plate spring which is interposed, through a movable plate 29, between the upper surface of the base portion 21 of the slider holder 20 and the inner surface of the top wall of the cover 19, thereby to always urge the slider holder 20 against the resistor base 1 at a suitable sliding pressure.

Figure 7:
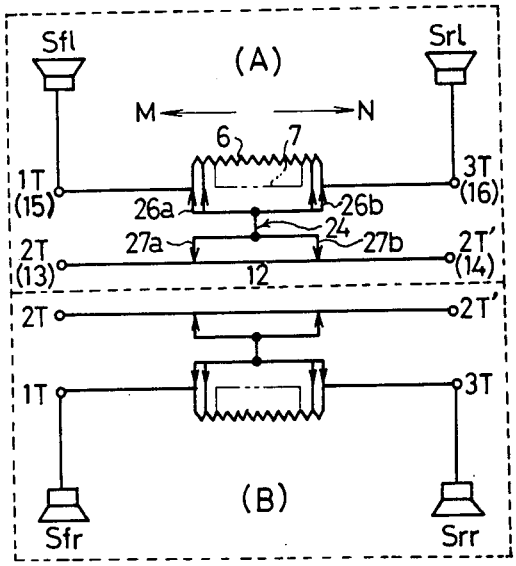
FIG. 7 is a schematic of an electric circuit incorporating the illustrative embodiment.

Operation of the above-described embodiment will now be described in conjunction with FIG. 7. FIG. 7 is a schematic circuit diagram wherein loudspeakers are connected to the variable resistor of the present invention. In FIG. 7, the numerals 1T and 3T represent respectively the output terminals 15 and 16, and the numerals 2T and 2T' represent respectively the input terminals 13 and 14. To either one of the input terminals 2T and 2T' in block (A) are applied lefthand sound signals of stereophonic sound signals, while righthand sound signals are applied to one of the input terminals 2T and 2T' in block (B). Symbols Sfl, Srl, Sfr and Srr indicate dynamic loudspeakers which are adapted to be located at the forward lefthand portion, the rearward lefthand portion, the forward righthand portion and the rearward righthand portion, respectively. One end of the voice coils of the loud-speakers Sfl and Srl are connected respectively to the terminals 1T and 3T in the block (A), and one end of the voice coils of the loudspeakers Sfr and Srr are connected respectively to the terminals 1T and 3T in the block (B). The other ends of the voice coils of the loudspeakers are grounded.

Accordingly, at the time when the sliders 24 are at the center position (when the slider holder 20 is at the center position) as shown in FIG. 7, sound volumes offered by the respective loudspeakers Sfl, Sfr, Srl and Srr are equal with respect to one another. When the sliders 24 are moved in the direction of arrow M, there occurs no variation in sound volumes of the loudspeakers Sfl and Sfr because the contact pieces 26*a* come into contact with the conductive portions 4*a* while sound volumes of the loudspeakers Srl and Srr become smaller gradually with the movement of the sliders 24 because the contact pieces 26*b* come into contact with the respective tap portions 7. On the other hand, when the sliders 24 are moved from the center position to the direction of arrow N, variation of sound volumes of the loudspeakers becomes contrary to the above.

Figure 8:
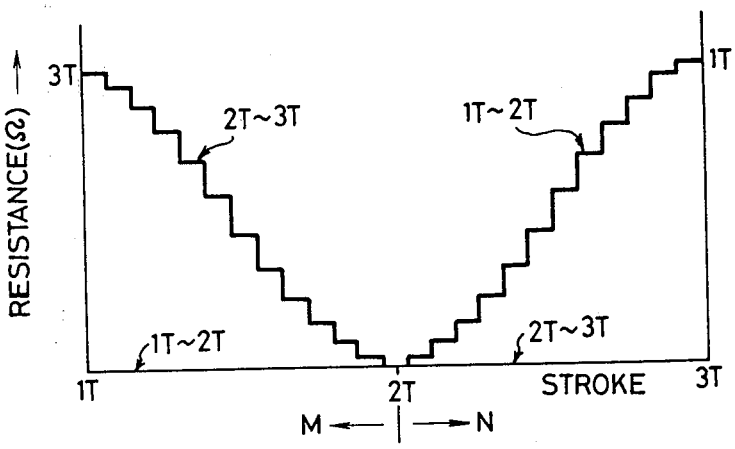
FIG. 8 is a graph showing an output characteristic of the illustrative embodiment.

FIG. 8 is a graph showing variations in resistances appearing between the terminals 2T and 3T and between the terminals 1T and 2T when the sliders 24 are moved from the center position shown in FIG. 7 in the direction of arrow M and in the direction of arrow N, respectively.

While the invention has been described in conjunction with the preferred embodiment thereof, it should be understood that the invention is not limited to such embodiment and various changes and modifications can be made without departing from the spirit and the scope of the present invention which is defined by the appended claims.

What is claimed is:

1. A variable resistance apparatus of slide type comprising:

a housing;

an insulating base plate secured in said housing;

first and second resistor units provided on said insulating base plate, each of said first and second resistor units including a resistor member having conductive portions connected to the opposite ends thereof and including a plurality of conductive taps extending transversely from said resistor member, said conductive taps being arranged in parallel with respect to one another;

a central isolation band provided between said first and second resistor units;

an elongated bridge member consisting of insulating material and being provided above said first and second resistor units;

first and second conductive bands provided on said bridge member, said conductive bands being insulated from and arranged in parallel with respect to each other; and a slider holder movably mounted in said housing and holding first and second sliders, said first and second sliders being adapted to slidingly contact with the conductive portions and the conductive taps in said first and second resistor units, respectively, and with the corresponding conductive bands on said bridge member.

2. A variable resistance apparatus according to claim 1, wherein said resistor members in said first and second resistor units are located near to said central isolation band so that said resistor members are out of the slide tracks along which said first and second sliders are slidingly moved, respectively.

3. A variable resistance apparatus according to claim 1, wherein the opposite end portions of said first and second conductive bands extend outwardly from said housing to form output terminals.

4. A variable resistance apparatus according to claim 1, wherein each of said first and second sliders include a plurality of contact pieces extending in opposite directions with respect to each other.

5. A variable resistance apparatus according to claim 4, wherein the distance between the extemities of said contact pieces which extend in the opposite directions with respect to each other is substantially equal to the length of said resistor member in said resistor unit.

6. A variable resistance apparatus according to claim 1, wherein said plurality of conductive taps are disposed at constant angles with respect to the direction of movement of said slider.

7. A variable resistance apparatus according to claim 1 or 6, further including coatings of insulating material provided between said plurality of conductive taps thereby to make the slide tracks for said slider smooth.

8. A variable resistance apparatus according to claim 1, further including a plurality of fins provided to said insulating base plate for radiating heat.

* * * * *